United States Patent [19]

Skrobisch

[11] 3,936,818

[45] Feb. 3, 1976

[54] ELECTROMAGNETIC INDICATOR HAVING OPPOSITELY MAGNETIZED STAMPED MAGNETIC CORES

[75] Inventor: Alfred Skrobisch, Huntington, N.Y.

[73] Assignee: The Staver Company, Incorporated, Bay Shore, N.Y.

[22] Filed: July 15, 1974

[21] Appl. No.: 488,465

Related U.S. Application Data

[63] Continuation of Ser. No. 381,880, July 23, 1973, abandoned.

[52] U.S. Cl. ..... 340/373; 340/378 R

[51] Int. Cl.[2] ..... G08B 5/24

[58] Field of Search ..... 340/373, 378 R, 336; 335/229

[56] References Cited

UNITED STATES PATENTS 3,543,202 11/1970 Naybor ..... 340/373 X

*Primary Examiner*—Harold I. Pitts

[57] ABSTRACT

An electromagnetic indicator assembly includes a nonmagnetic angle plate defining a support frame for axially parallel spaced rotors each including a permanent magnet and a nonmagnetic plate circumferentially surrounding a portion of the magnet. The rotors carry symbols for display at window openings in the support frame. Another angle plate made of magnetic metal has stamped laterally spaced integral fingers defining magnetic cores carrying magnetizing coils axially perpendicular to the rotors. Ends of the cores serve as abutments for spaced edges of the rotor plates to stop rotation thereof. Adjacent cores are oppositely magnetized and adjacent rotors are oppositely magnetized to prevent rotation of adjacent rotors when any one rotor is selectively turned to display a symbol. The coils may be energized to hold the rotors latched against rotation in both stationary positions; or may be energized only for the purpose of turning a rotor to display a symbol, with the rotor returning to an original stationary position magnetically when the coil is deenergized.

11 Claims, 12 Drawing Figures

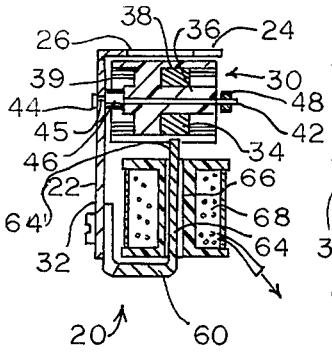
FIG.5
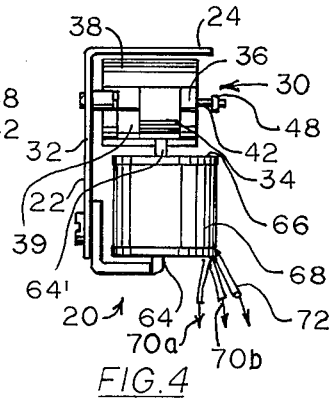
FIG.4
FIG.7
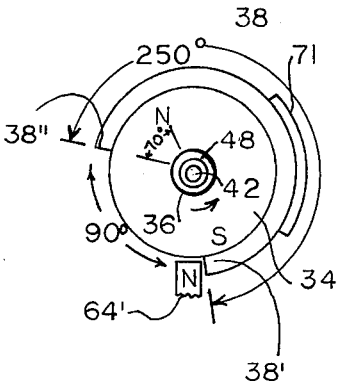
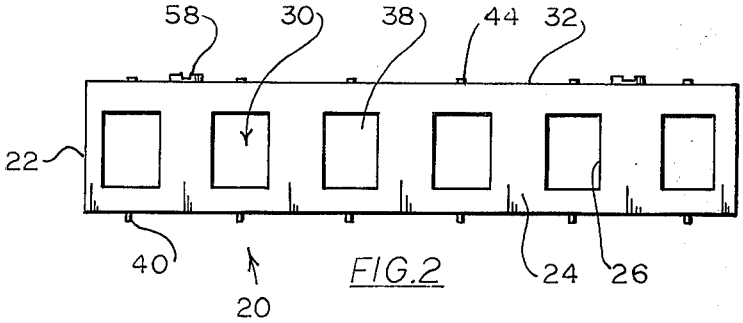
FIG.2
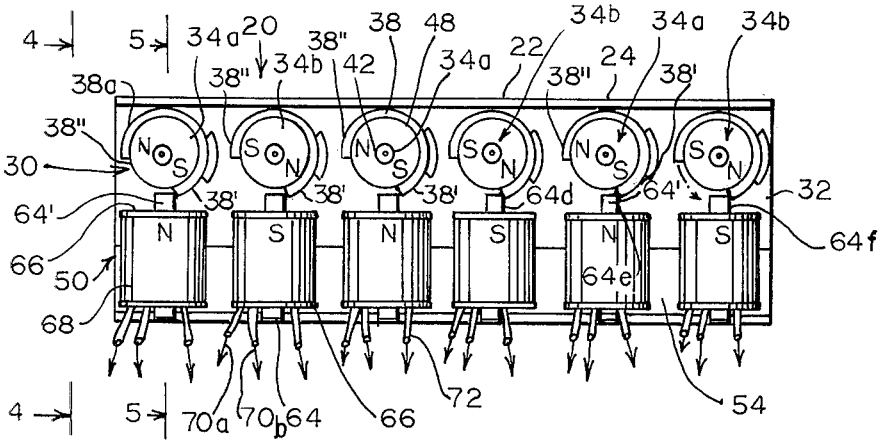
FIG.3
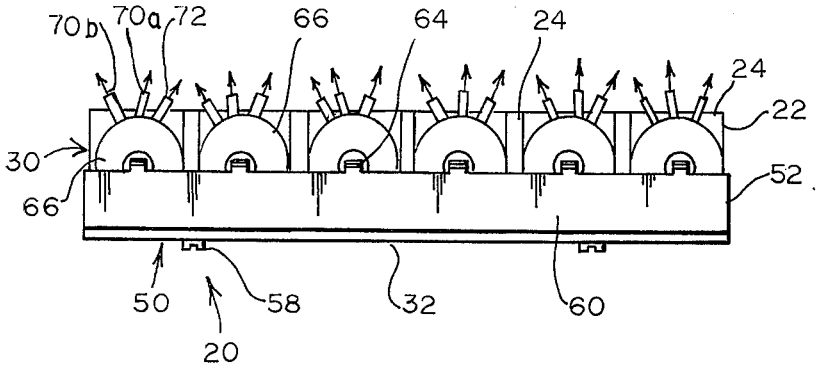
FIG.6

ELECTROMAGNETIC INDICATOR HAVING OPPOSITELY MAGNETIZED STAMPED MAGNETIC CORES

This is a continuation of application Ser. No. 381,880, now abandoned, filed July 23, 1973.

This invention relates to the art of electromagnetic indicators, and more particularly concerns an indicator having a stator assembly including a stamped magnetic plate defining a plurality of magnetic cores.

Electromagnetic indicators heretofore known have been rather complex in construction because they consisted of individual electromagnetic units which had to be hand assembled to form a multiple unit assembly. They included costly magnetic shielding to prevent actuation of adjacent units when any one unit was actuated.

The present invention is directed at overcoming the foregoing by providing a simplified structure for electromagnetic indicator and thereby reducing cost of manufacture by saving material and assembly time. According to the invention there is provided an indicator assembly including a stator subassembly comprising an angle plate made of magnetic metal. This plate is stamped to define laterally spaced parallel fingers which constitute cores for magnetizing coils. The circuit for energizing the coils is such that the cores are oppositely polarized magnetically. The indicator assembly further includes magnet rotors mounted on the plate carrying the stator subassembly. The rotors have cylindrical magnets with diametrically opposite magnetic poles. Adjacent rotors are oppositely polarized. This permits rotation of any one rotor when its associated stator core is magnetized without causing rotation of adjacent rotors. Each rotor includes an outer arcuate nonmagnetic shield or plate having free edges disposed at opposite sides of a free end of the magnetic core, to serve as an abutment to limit rotation of the rotor and to stop rotation in either one of two positions for displaying a symbol carried thereon or for concealing the symbol. The indicator assembly may be arranged to latch in either one of two positions or to operate without latching.

Accordingly a primary object of the present invention is to provide an electromegnetic indicator assembly having a simplified structure.

Another object of the present invention is to provide an electromagnetic indicator having a plurality of adjacent magnetic cores without magnetic shielding thereinbetween.

These and other objects and many of the attendant advantages of this invention will be readily appreciated as the same becomes better understood by reference to the following detailed description when considered in connection with the accompanying drawings in which:

FIG. 2 is a top plan view of the assembly of FIG. 1;

FIG. 3 is a rear view of the assembly;

FIG. 4 is an end view of the assembly taken along line 4—4 of FIG. 3;

FIG. 5 is a cross sectional view taken along line 5—5 of FIG. 3;

FIG. 6 is a bottom plan view of the assembly;

FIGS. 7 and 7A are graphic diagrams of enlarged end views of two different rotors;

Figure 1:
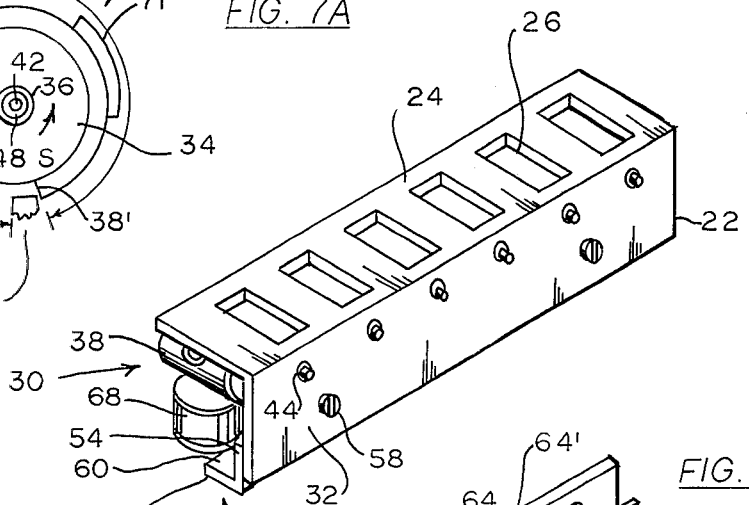
FIG. 1 is a perspective view of an electromagnetic indicator assembly embodying the invention.

Referring now to the drawings wherein like reference characters designate like or corresponding parts throughout; there is illustrated in FIG. 1, an indicator assembly generally designated as reference numeral 20, including a rectangular angle frame plate 22 which serves as a mounting frame for the assembly. The plate 22 has a top wall 24 formed with a plurality of rectangular window openings 26 through which rotors 30 are visible. A side wall 32 of the plate 22 rotatably carries the rotors 30.

Each of the rotors 30 as best shown in FIG. 5 includes a disk shaped permanent magnet 34 with diametrically opposed N and S poles. The magnet 34 is mounted on an axial stem 36 of a nonmagnetic partially cylindrical indicator plate or shield 38. The stem 36 is integral with an annular web 39 which in turn is peripherally integral with the plate 38. The stem 36 has an axial hole 40 through which extends a nonmagnetic metal pin 42 terminating in a head 44. The pin 42 extends axially through a hole 45 in the wall 32 of the plate 22. A cylindrical spacer 46 is fitted on the pin 42 at the inner side of the wall 32. The plate 38 and the magnet 34 rotate freely on the pin 42. A nut 48 at the rear free end of the pin 42 holds the rotor 30 on the wall 32. A plurality of the rotors 30 are similarly mounted in laterally spaced position on the wall 32 adjacent to the window openings 26.

Figure 9:
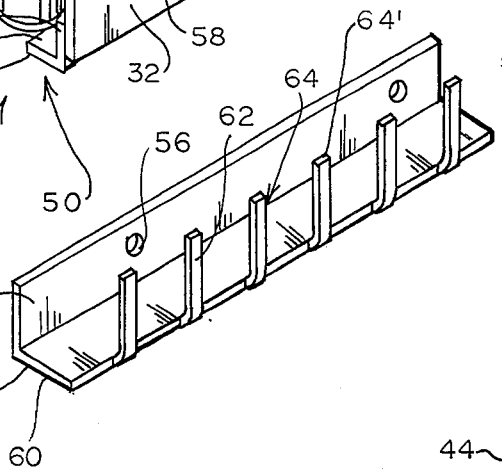
FIG. 9 is a perspective view of a stamped metal plate defining a plurality of magnetic cores.

The wall 32 also carries a stator assembly generally designated as reference 50, which includes a stamped rectangular magnetic metal plate 52 as illustrated in FIG. 9. The plate 52 has one flat flange 54 provided with a pair of spaced threaded holes 56 which engage a respective screw 58 extending through registering holes in the wall 32. The plate 52 has a bottom flange 60 formed with a plurality of integral upwardly bent laterally spaced fingers 62 which constitute the magnetic cores 64 of the assembly 50. On each of the cores 64 is a nonmagnetic spool 66 carrying a wire coil 68 (FIG. 3) terminating in a pair of wire leads 70*a* and 70*b*. When the indicator assembly is used in a latch indicating mode a center tap of the wire coil 68 is used which terminates in a lead 72 as illustrated in FIG. 3, 4, 6 and 10.

Figure 7A:
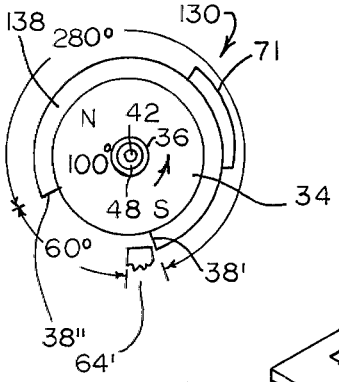
Figure 8:
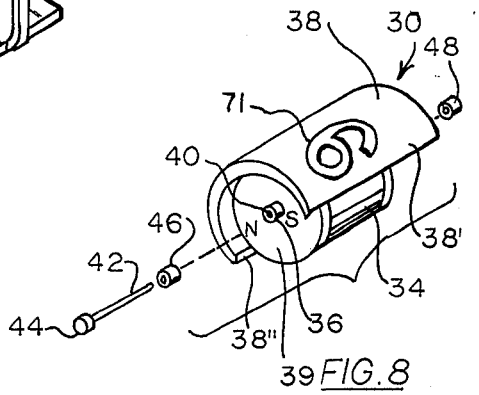
FIG. 8 is an exploded perspective view of parts of a rotor.

Each of the magnets 34 is permanently magnetized with N and S poles spaced 180° apart. As viewed in FIG. 3, the poles are alternated in polarity in adjacent rotors, with one S pole of the magnet 34*a* adjacent to the right or bottom edge 38′ of the indicator plate 38, while next magnet 34*b* has the N pole adjacent to the bottom edge 38′. As clearly illustrated the left or top edge 38″ of the plate 38 extends about 70° beyond the pole in FIG. 7. Each indicator plate 38 extends 250° around the rotor 30 and in normal operation rotates about 90° counterclockwise, as viewed in FIG. 3, to expose at the window opening 26 a number or a letter 71 inscribed on the outer side of the plate 38 (see FIG. 8).

In a normal magnetically latched position, the N or S pole at the plate edge 38' abuts the core end 64' of the associated stator core. In normal operation the cores 64 are alternately magnetized with opposite polarity due to the manner in which the associated coil 68 is energized. For example, as shown in FIG. 3, looking from right to left, cores 64 when energized, would be alternately magnetized S and N and magnetically engage the N and S poles respectively of the rotors 30. The end 64' of each core 64 limits rotation of the rotor 30 in opposite directions by serving as a stop or abutment for the edges 38' and 38'' of the indicator plate 38. The alternate magnetic polarity of the rotors 30 provides unexpected advantages explained below.

Figure 10:
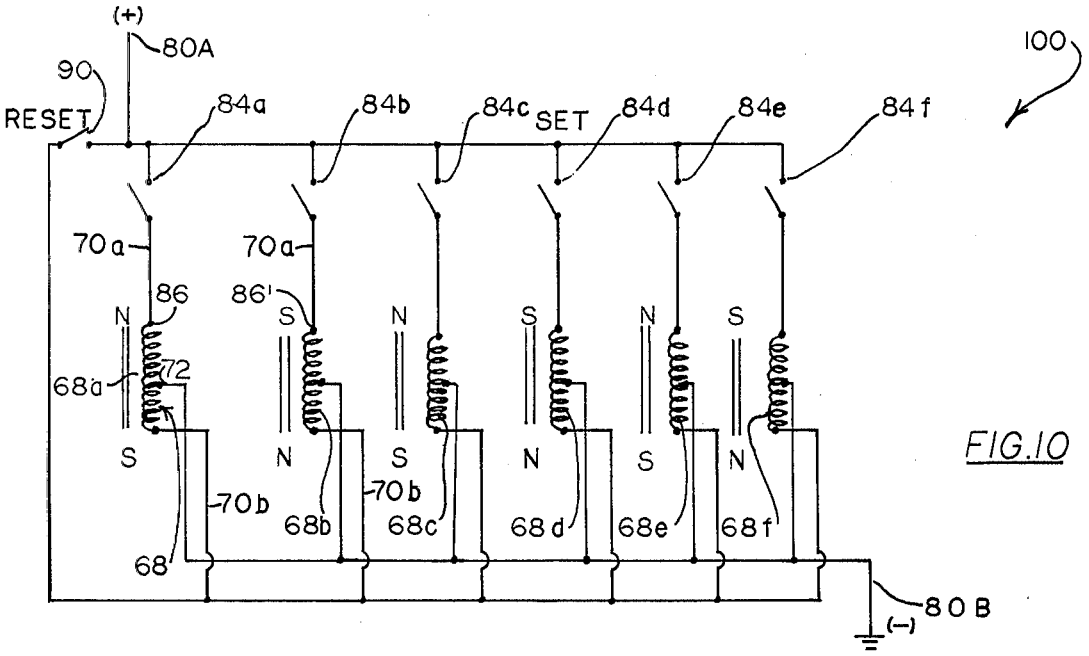
FIG. 10 is a diagram of an electric circuit which can be used to energize the indicator assembly in a latching mode.

FIG. 10 shows an electric circuit generally designated as reference numeral 100 which may be used to energize the coils 68 from a D.C. source 80 when the indicator assembly is used in the latching mode. The center tap 72 from each of the coils 68 are connected to a negative side 80B of a D.C. source. All of the coil leads **70*b* are connected to a common lead 88 which is in turn connected to a single pole double throw switch 90 connected to the positive side 80A of the D.C. source. All of the coil leads 70*a* are connected via a switch 84 to the positive terminal 80A of the D.C. source. In operation of the assembly 20 including the circuit 100 change of the polarity of a coil 68 is effected by a momentary closing and opening of its associated switch 84. For example change of polarity of the core 64*e* (FIG. 3) from N to S is effectuated by momentary closing and opening of the switch 84*e* which will repel the S pole of the rotor 34 and simultaneously attract its N pole thereby causing this rotor to rotate counterclockwise approximately 90° until the edge 38'' is stopped by the end 64' of the stator core 64. The two adjacent magnetic cores 64*d* and 64*f* are not magnetized by their respective coil windings. They continue to engage magnetically the N poles of adjacent rotors 30. The reversal of the magnetic field of the core 64*e* to S polarity has no adverse effect on the adjacent rotors 30*d* and 30*f*, but instead tends by repulsion of neighboring poles to hold rotors 30*d* and 30*f* stationary. If this opposite magnetic polarity of adjacent rotors and stators had not been provided, the reversal of any one core would tend to repel the rotors of adjacent coils and cause them to turn undesirably. This alternation of magnetic polarities provides the additional advantage that magnetic shielding between adjacent cores and rotors is not required. This simplifies the structure and reduces material requirements and manufacturing cost. All of the rotors which have been energized are returned to their original positions by actuation of switch 90. Those rotors which have not been previously energized will remain uneffected by closing of switch 90** since they are already in their original position.

It will be noted that each rotor is latched magnetically in a stationary position at each extreme of rotation. This mode of operation conserves power since the coils are not energized until they are required to effect display of one of the letters or number 71.

It is also possible to operate without latching. For this purpose the rotors 30 are modified as illustrated in FIG. **7*a* as rotors 130. Nonmagnetic plates 138 extend about 280° around the rotor and rotate about 60°. In this arrangement, the alternate N and S poles of the adjacent rotors will be magnetically attracted to and will remain in contact with the upwardly projecting core end 64'** of each associated demagnetized stator core.

Figure 11:
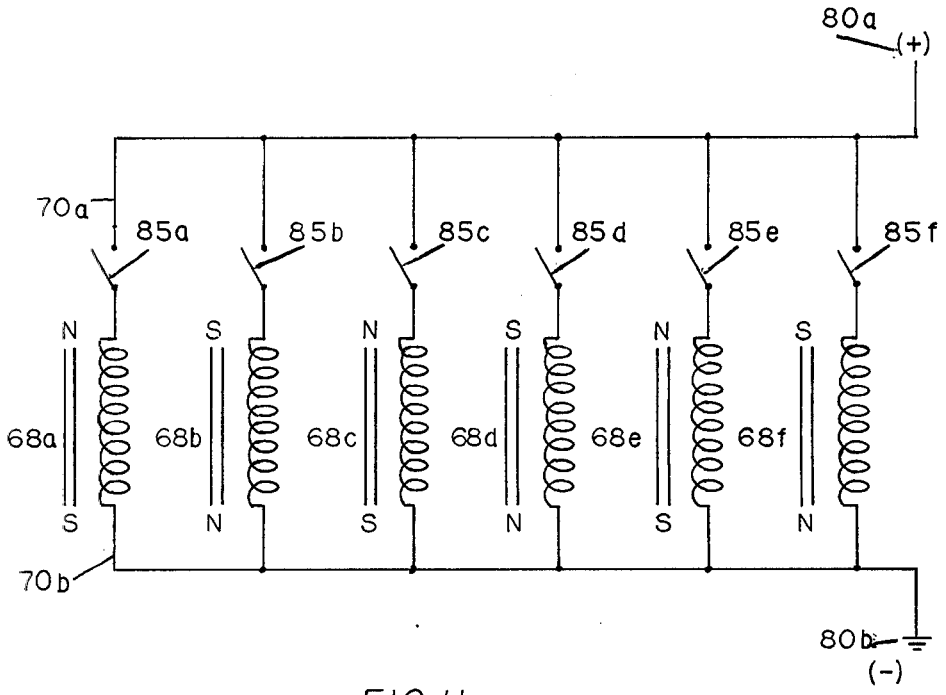
FIG. 11 is a diagram of an electric circuit which can be used to energize the indicator assembly in a nonlatching mode.

To display any of the numbers of letters 71, the selected coil 68 will be energized by closure of each switch 85 (FIG. 11). Each of the respective coils 86 have the leads **70*a* connected to one side of their respective switches 85. The other side of the switch 85 is connected to the positive terminal 80A of a D.C. source. The lead 70*b* of each of the coils 68 is connected via lead 88 to the negative terminal 80B of the D. C. source. Closure of any of the switches 85 will have the effect of repelling the magnetically engaged rotor 130 causing the rotor to rotate counterclockwise about 60° until the edge 38'' engages the core end of the energized coil 130. In this non-latching mode the rotor will remain in its position only as long as the switch is closed. When the switch 85 is opened, energizing current for the coil is cutoff, and the rotor 30 returns, by rotating clockwise until the edge 38' magnetically contacts the core end 64', inasmuch as the S pole of the rotor 138 is always closer to the core 64'** than the N pole.

The present invention is characterized by its simplicity of structure. A plurality of indicator display units can be made up into an assembly of any desired number quickly and easily due to the modular construction.

It should be understood that the foregoing relates to only a preferred embodiment of the invention and that it is intended to cover all changes and modifications of the example of the invention herein chosen for the purpose of the disclosure, which do not constitute departures from the spirit and scope of the invention.

The invention claimed is:

1. An electromagnetic indicator assembly, comprising:

a support frame for displaying symbols;

a plurality of permanently magnetized rotors carried by said frame in laterally spaced axially parallel position, with each of said rotors carrying a symbol for display at said frame; and a stator assembly carried by said frame and comprising:

a stamped magnetic metal plate having a plurality of laterally spaced fingers each defining a magnetic core which terminates close to one of said rotors, and a plurality of stator coils each axially mounted on one of said cores for magnetizing the same when said coil is energized electrically to cause rotation in one direction of the adjacent rotor and displaying of said symbols carried thereon.

2. An electromagnetic indicator assembly as defined in claim 1, wherein said rotors each include a magnet having diametrically opposite magnetic poles, the magnets of adjacent rotors being magnetized with opposite magnetic polarity; and further comprising circuit means for so energizing the stator coils that the adjacent cores have opposite polarity to cause rotation of any selected rotor in said one direction while magnetically preventing rotation of other rotors adjacent to said selected rotor.

3. An electromagnetic indicator assembly as defined in claim 2, wherein each of said rotors includes a non-magnetic cylindrically curved plate carrying one of said symbols to be displayed, said non-magnetic plate partially enclosing said magnet of said rotor and extending circumferentially around said magnet less than 360° to define two spaced free edges; each of said cores having a free end extending out of said stator coil and terminating adjacent one of said rotors in the space between said two free spaced edges of said nonmagnetic rotor plate, which serves as an abutment for limiting rotation of said rotor.

4. An electromagnetic indicator assembly as defined in claim 3, wherein said circuit means includes a direct current source, a first switching means connected thereto for energizing said coils and driving said rotors in said one direction and a second switching means connected to said direct current source for rotating said rotors in a direction opposite said one direction whereby said rotors are held stationary magnetically in either one of two positions with one of said edges of said nonmagnetic rotor plates in abutment with said free core end.

5. An electromagnetic indicator assembly as defined in claim 4, wherein each of said nonmagnetic rotor plates extends circumferentially approximately 250° around said rotor magnet so that said rotor turns approximately 90° to display said symbol on said nonmagnetic plate when an associated stator coil is energized.

6. An electromagnetic indicator assembly as defined in claim 3, wherein each of said nonmagnetic rotor plates extends circumferentially approximately 250° around a rotor magnet so that said rotor turns approximately 90° to display said symbol on said nonmagnetic plate when an associated stator coil is energized.

7. An electromagnetic indicator assembly as defined in claim 3, wherein each of said nonmagnetic rotor plates extends circumferentially approximately 280° around each of said rotor magnets so that one of said rotors turns approximately 60° in one direction to display said symbol when an associate stator coil is energized, whereby said turned rotor returns to its initial position in a direction opposite said one direction when the associated stator coil is deenergized.

8. An electromagnetic indicator assembly as defined in claim 1, wherein said support frame comprises a wall having laterally spaced window openings for displaying said symbols respectively, and another wall rotatably supporting said rotors to display said symbols at said window openings respectively.

9. An electromagnetic indicator as defined in claim 1, wherein said metal plate comprises a first flange for mounting on said support frame, and a second flange integral with said first flange, said fingers being bent upwardly from said second flange parallel to said first flange to carry said coils.

10. An electromagnetic indicator as defined in claim 9, wherein said support frame comprises a first wall having laterally spaced window openings for displaying said symbols respectively, and another wall integral with said first wall and rotatably supporting said rotors for display of said symbols at said window openings respectively, said first flange being mounted in abutment with said first wall so that said second flange is parallel to said first wall and said fingers support said coils axially perpendicular to said rotors and said first wall.

11. An electromagnetic indicator assembly, comprising:

a support frame for displaying symbols;

a plurality of permanently magnetized rotors carried by said frame in laterally spaced axially parallel position, with each of said rotors carrying a symbol for display at said frame;

each of said rotor having a magnet having diametrically opposite magnetic poles, the magnets of adjacent rotors being magnetized with opposite magnetic polarity;

a stator assembly carried by said frame and comprising:

a plurality of metallic magnetic cores each of which terminates close to one of said rotors, and a plurality of stator coils each axially mounted on one of said cores for magnetizing the same when said coil is energized electrically to cause rotation in one direction of a selected rotor and displaying of said symbol carried thereon, and circuit means for so energizing said stator coils that the adjacent cores have opposite polarity thereby causing rotation of said selected rotor in said one direction while magnetically preventing rotation of other rotors adjacent to said selected rotor.

* * * * *